US006948465B2

(12) United States Patent
Daigo et al.

(10) Patent No.: US 6,948,465 B2
(45) Date of Patent: Sep. 27, 2005

(54) VARIABLE VALVE MECHANISM FOR ENGINE

(75) Inventors: Yasunori Daigo, Tokyo (JP); Masahiro Maekawa, Tokyo (JP); Koichi Kawamoto, Kawasaki (JP); Manabu Horiuchi, Kawasaki (JP); Satoshi Nakajima, Kawasaki (JP)

(73) Assignees: Mitsubishi Fuso Truck and Bus Corporation (JP); Fuso Engineering Corporation (JP)

( * ) Notice: Subject to any disclaimer, the term of this patent is extended or adjusted under 35 U.S.C. 154(b) by 0 days.

(21) Appl. No.: 10/952,280

(22) Filed: Sep. 28, 2004

(65) Prior Publication Data

US 2005/0066921 A1 Mar. 31, 2005

(30) Foreign Application Priority Data

Sep. 30, 2003 (JP) ..... 2003-340834

(51) Int. Cl.[7] ..... F01L 1/34

(52) U.S. Cl. ..... 123/90.16; 123/90.15; 123/90.2; 123/90.27; 123/90.44; 123/90.4

(58) Field of Search ..... 123/90.16, 90.2

(56) References Cited

U.S. PATENT DOCUMENTS 4,357,917 A 11/1982 Aoyama
6,053,135 A * 4/2000 Ochiai et al. ..... 123/90.16
6,755,022 B2 6/2004 Kim et al.
6,763,793 B2 * 7/2004 Murata et al. ..... 123/90.39
6,769,392 B2 8/2004 Lawrence et al.
6,832,584 B2 * 12/2004 Murata et al. ..... 123/90.16

FOREIGN PATENT DOCUMENTS

JP 2000-345872 A 12/2000

* cited by examiner

*Primary Examiner*—Thomas Denion
*Assistant Examiner*—Kyle M. Riddle
(74) *Attorney, Agent, or Firm*—Rossi, Kimms & McDowell, LLP

(57) ABSTRACT

A variable valve mechanism has a switching mechanism for transmitting cam displacement to a first rocker arm from a second rocker arm. A camshaft is disposed obliquely above a rocker shaft. A first abutting portion and a second abutting portion are disposed in a dead space between an upper side of the rocker shaft and a side of the camshaft. The first abutting portion rotationally displaces in a rotational direction of rocker arms together with the first rocker arm. The second abutting portion rotationally displaces together with the second locker arm. The second abutting portion abuts on the first abutting portion from a rotating direction of rocker arms. In the switching mechanism thus configured, displacement of the second rocker arm is transmitted to the first rocker arm with reduced stress burden.

7 Claims, 7 Drawing Sheets

VARIABLE VALVE MECHANISM FOR ENGINE

CROSS-REFERENCE TO RELATED APPLICATIONS

This application is based upon and claims the benefit of priority from prior Japanese Patent Application No. 2003-340834, filed Sep. 30, 2003, the entire contents of which are incorporated herein by reference.

BACKGROUND OF THE INVENTION

1. Field of the Invention

The present invention relates to a variable valve mechanism which allows switching of cams driving a valve by selection of rocker arms.

2. Description of the Related Art

In a reciprocating internal combustion engine, a cam switching type variable valve mechanism is used in a valve train in order to achieve both improvement in output and improvement in fuel consumption. The cam switching type variable valve mechanism is an apparatus which switches opening/closing timings of a valve (a intake valve or an exhaust valve) or valve lifts by switching of cams. In a representative variable valve mechanism, a plurality of cams different in cam profile are provided on one camshaft. Opening/closing timings of a valve or valve lifts are switched by switching rocker arms for each cam driven by these cams.

In an engine, a camshaft may be arranged on an obliquely upper side of a rocker shaft in order to avoid interference among respective sections of the engine to achieve compactness of a cylinder head. In such an engine, a pin type variable valve mechanism is used so as not to injure compactness of the cylinder head.

One example of a conventional pin type variable valve mechanism is described in Jpn. Pat. Appln. KOKAI Publication No. 2000-345872. In the variable valve mechanism, one of a plurality of rocker arms adjacent to one another stores therein a pin which can project from/retract to the other rocker arm. The other rocker arm is formed with a recess in which a distal end of the pin projected is fitted. With this configuration, a cam displacement transmitted from the one rocker arm is transmitted to a valve at a time of retraction of the pin. When the pin is projected, the pin is fitted into the recess of the other rocker arm so that the both the rocker arms are coupled to each other. Thereby, a cam displacement transmitted from the other rocker arm is transmitted to the valve via the pin and the one rocker arm.

The configuration where two rocker arms adjacent to each other are coupled using the pin is excellent in compactness but there is a drawback in cost because of the following reasons.

In the pin type variable valve mechanism, in a coupled state of two rocker arms, the rocker arms are rotationally displaced to drive the valve while a shearing stress is being applied to the pin. For this reason, a relatively large shearing stress acts on the pin or the rocker arms. Therefore, in the pin type variable valve mechanism, means for securing a stable cam switching operation, such as remarkable improvement in mechanical strength of the pin or the rocker arms is required. Therefore, the pin type variable valve mechanism will cause increase in cost easily.

BRIEF SUMMARY OF THE INVENTION

An object of the invention is to provide a variable valve mechanism which allows a compact constitution of a cylinder head for an engine and can achieve reduction in stress burden.

According to a first aspect of the present invention, there is provided a variable valve mechanism for an engine, where the engine has: a rocker shaft which is arranged to a cylinder head; a camshaft which is arranged on the cylinder head in parallel with the rocker shaft and above the rocker shaft and has a first cam and a second cam which are different in cam profile from each other; a first rocker arm which is rotatably supported by the rocker shaft and is driven by the first cam, and which transmits a displacement of the first cam to a valve; and a second rocker arm which is rotatably supported by the rocker shaft in parallel to the first rocker arm and is driven by the second cam, wherein the variable valve mechanism has a switching mechanism which allows selective transmission of a displacement of the second rocker arm to the first rocker arm, the switching mechanism which is provided sideward of the camshaft, and the switching mechanism comprises: a first abutting portion which is provided on the first rocker arm; a second abutting portion which is provided on the second rocker arm and opposed to the first abutting portion with respect to rotational direction around the rocker shaft; and a switching element which is provided on one abutting portion of the first abutting portion and the second abutting portion, the switching element being displaceable to a first position where the switching element abuts on the other abutting portion of the first abutting portion and the second abutting portion to transmit displacement of the second rocker arm to the first rocker arm and a second position where the switching element does not abut on the other abutting portion.

According to the first aspect, the switching mechanism can be received in a dead space formed between an upper side of the rocker shaft and a side of the camshaft. The second abutting portion abuts on the first abutting portion in a rotational direction of the first rocker arm so that displacement of the cam is transmitted to the first rocker arm. For this reason, in the variable valve mechanism, a driving force is transmitted to the valve without generation of excessive stress. Therefore, both compactness of the cylinder head and reduction in stress can be achieved and switching of two kinds of cams can be performed.

According to a second aspect of the present invention, there is provided a variable valve mechanism according to the first aspect, wherein the first abutting portion is positioned at a side near to the camshaft to project from an upper portion of the first rocker arm, and the second abutting portion is positioned at a side far from the camshaft to be arranged so that a distal end thereof curves around a rear face side of the first abutting portion.

According to the second aspect, amounts of the first abutting portion and the second abutting portion projecting laterally of the rocker shaft are reduced. That is, the first abutting portion and the second abutting portion are reasonably arranged in a region defined by the upper side of the rocker shaft and the side of the camshaft.

According to a third aspect of the present invention, there is provided a variable valve mechanism according to the second aspect, wherein the first abutting portion has a cylindrical accommodating chamber which has a shape of projecting from an upper portion of the first rocker arm and has a window on a rear face side thereof, and the switching element which is movably accommodated in the accommodating chamber and is formed with a notched portion on an outer peripheral portion thereof, the first abutting portion being configured such that the notched portion and the outer peripheral portion can be selectively positioned at the window, and the second abutting portion has a distal end which advances to and retracts from the window according to rotational displacement of the second rocker arm, the second abutting portion being configured such that the distal end enters in the notched portion, when the notched portion is positioned at the window, and the distal end abuts on the outer peripheral portion, when the outer peripheral portion is positioned at the window.

According to the third aspect, in addition to the above advantage, such an advantage can be obtained that the switching mechanism can be configured of a combination of simple parts. Further, since a load transmitted from the distal end of the second abutting portion can be received even by a wall portion of the accommodating chamber which supports the switching element, a stress acting on a portion for transmission of a driving force is further reduced.

According to a fourth aspect of the present invention, there is provided a variable valve mechanism according to the third aspect, wherein the switching element is always biased to a position where the notched portion faces the window by a resilient member such as a spring, and is moved at a position where the outer peripheral portion faces the window, when hydraulic pressure is applied to the switching element.

According to the fourth aspect, such an advantage can be achieved that a required switching action can be performed by a simple configuration such as a combination of the resilient member and the hydraulic pressure in addition to the above advantage.

According to a fifth aspect of the present invention, there is provided a variable valve mechanism according to the third aspect, further comprising an oil chamber to move the switching element by hydraulic pressure, wherein an oil passage communicating with the oil chamber is formed in the rocker shaft.

According to a sixth aspect of the present invention, there is provided a variable valve mechanism according to the third aspect, further comprising a detent mechanism which prevents rotation of the switching element around an axis of the switching element.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be explained below with reference to FIG. 1 to FIG. 11.

Figure 1:
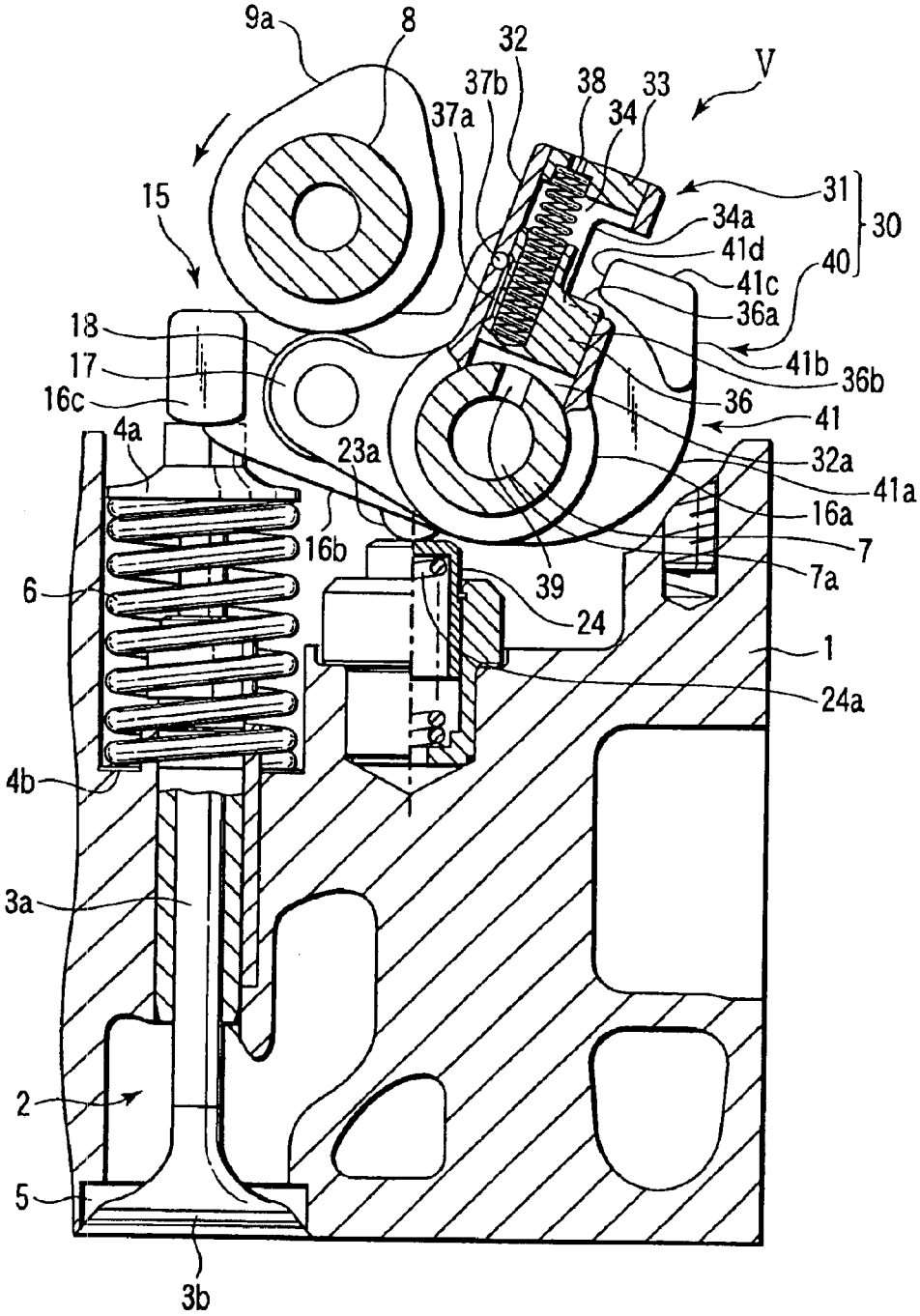
FIG. 1 is a vertical sectional view showing a cylinder head of an engine assembled with a variable valve mechanism according to one embodiment of the present invention.

FIG. 1 shows a section of a portion of a diesel engine of a reciprocating type to which the present invention is applied. A plurality of cylinders of an engine (not shown) are arranged in series along a longitudinal direction (front and rear directions) of the engine. In a cylinder head 1 of the engine, two intake valves 2 are provided along front and rear directions of the cylinder head 1 for each cylinder. FIG. 1 shows one of the intake valves 2.

Each intake valve 2 has a valve stem 3*a* and a valve head 3*b*. The valve stem 3*a* is supported to the cylinder head 1 slidably in a vertical direction (in up and down directions). The valve head 3*b* opens and closes a intake port 5 of a lower face of the cylinder head 1. The valve stem 3*a* is provided with a valve seat member 4*a*. A valve seat portion 4*b* is formed on an upper face of the cylinder head 1.

A valve spring 6 is provided between the valve seat member 4*a* and the valve seat portion 4*b* in a compressed state. The intake valve 2 is always pushed up by a resilient force of the valve spring 6 to close the intake port 5. When valve stem 3*a* is pushed down, the intake port 5 is opened.

Figure 2:
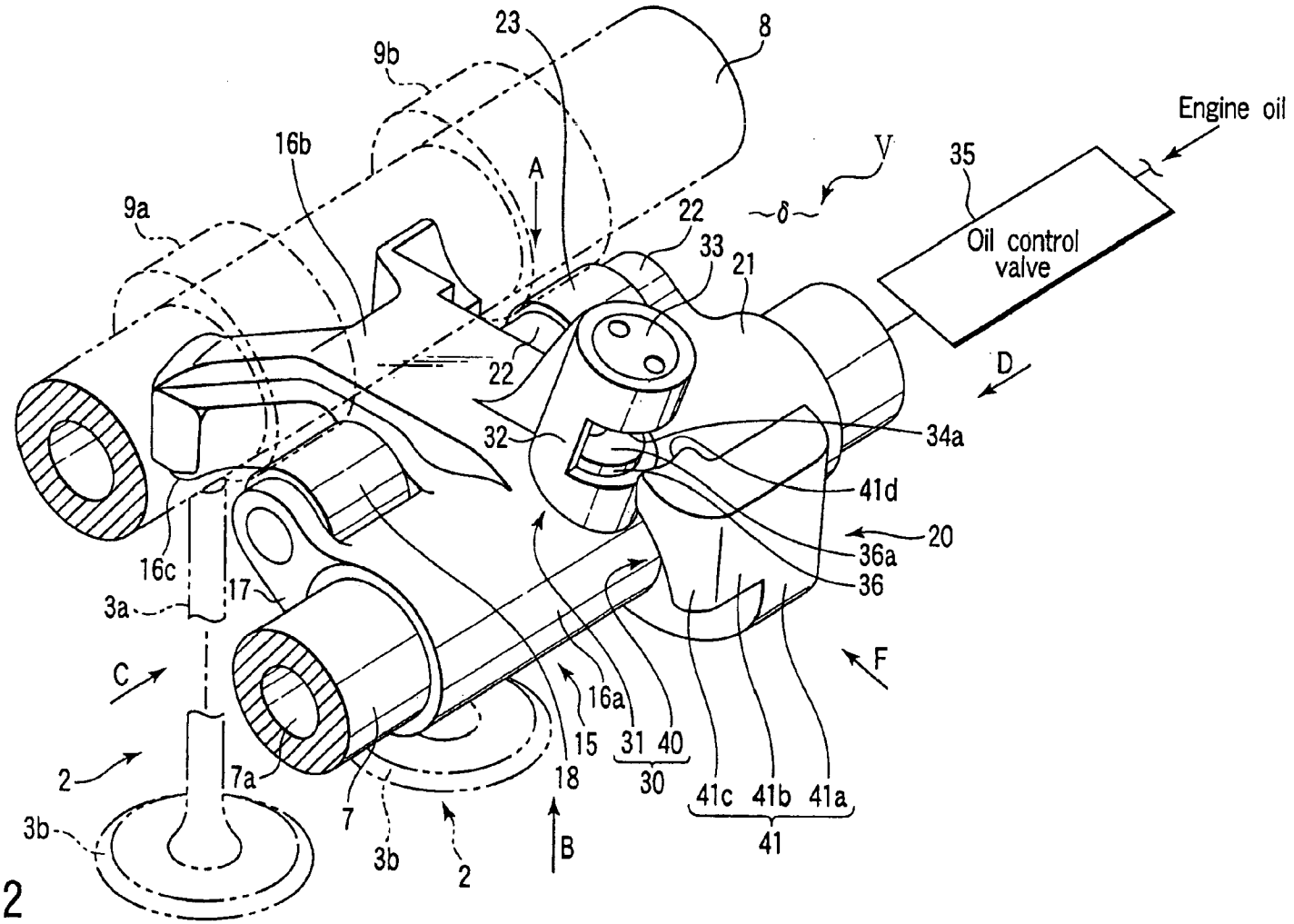
FIG. 2 is a perspective view of the variable valve mechanism shown in FIG. 1.

As shown in FIG. 1 and FIG. 2, a rocker shaft 7 is disposed above the cylinder head 1. The rocker shaft 7 is provided at a position where it is slightly shifted from intake valve 2 outside the cylinder head 1 (in a widthwise direction). The rocker shaft 7 is disposed at a lower position such as, for example, a height approximately equal to an upper end of the valve stem 3*a*.

A camshaft 8 for intake is rotatably disposed between the rocker shaft 7 and the valve stem 3*a*. The camshaft 8 is provided slightly above the rocker shaft 7. That is, as shown in FIG. 4 to FIG. 9, the camshaft 8 is disposed obliquely above the rocker shaft 7 in parallel with the rocker shaft 7. Both the rocker shaft 7 and the camshaft 8 extend along front and rear directions of the cylinder head 1.

Figure 4:
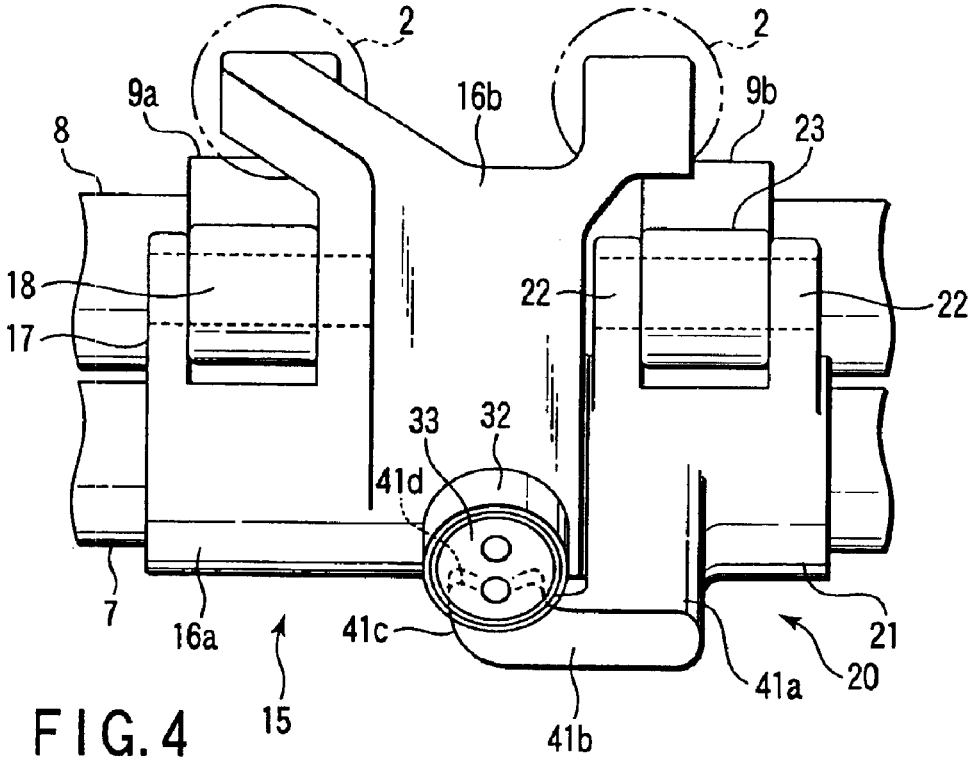
FIG. 4 is a plan view of the variable valve mechanism as viewed from in a direction of arrow A in FIG. 2.
Figure 5:
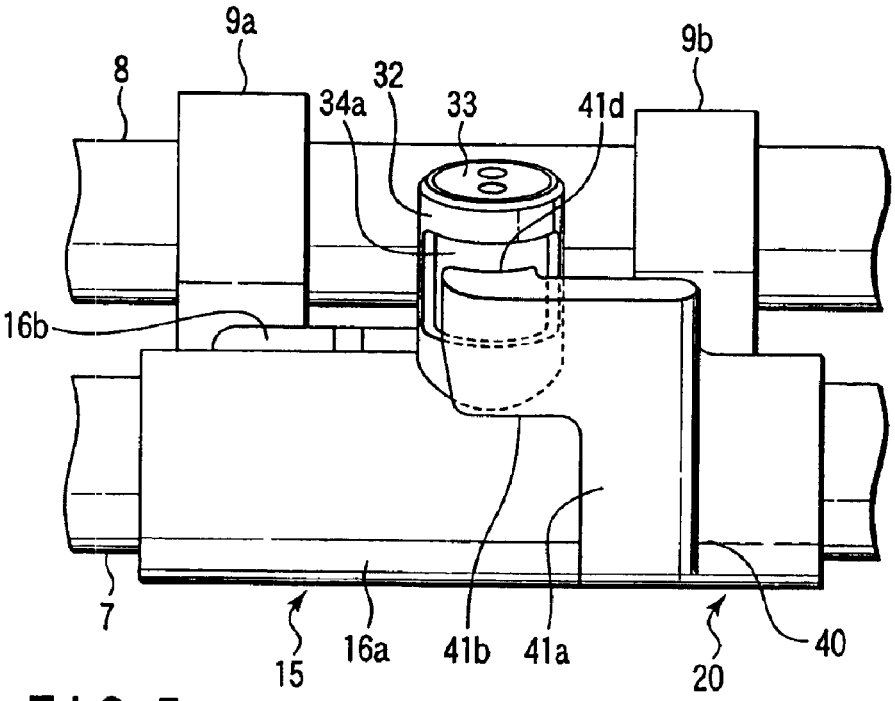
FIG. 5 is a rear view of the variable valve mechanism as viewed from in a direction of arrow F in FIG. 2.

As shown in FIG. 4 and FIG. 5, the camshaft 8 is formed with a first cam 9*a* and a second cam 9*b* for intake. The two kinds of cams 9*a* and 9*b* are different in cam profile from each other. The cams 9*a* and 9*b* are provided on both sides of a cylinder around a center thereof for each cylinder.

Figure 11:
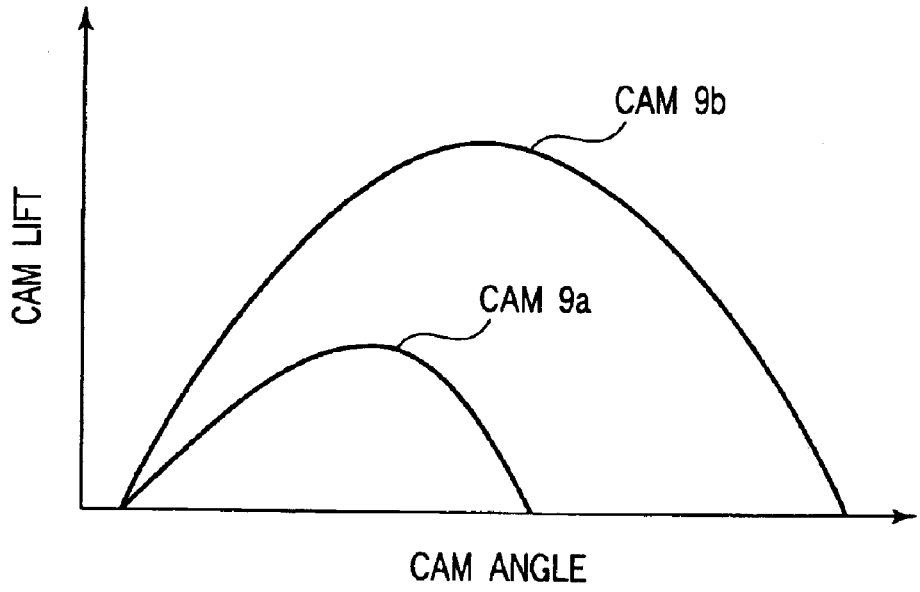
FIG. 11 is a diagram showing lift amounts of a cam for a low speed and a cam for a high speed and timings of valve opening/closing.

The first cam 9*a* positioned on a left side on FIG. 4 and FIG. 5 is for a low speed and a cam profile thereof is set to a valve opening/closing timing and a valve lift amount suitable for a low speed operation of the engine. The second cam 9*b* positioned on a right side is for a high speed, and a cam profile thereof has the same base circle as that of the cam 9*a* for a low speed and is set to a valve opening/closing timing and a valve lift amount suitable for a high speed operation. The valve lift amount of the cam profile of the second cam 9*b* for a high speed is larger than the valve lift amount of the cam profile of the first cam 9*a* for a low speed. As shown in FIG. 11, such setting is employed that a valve lift amount of the first cam 9*a* is necessarily positioned inside a curve showing a relationship between a lift amount of the cam 9*b* and a valve opening/closing timing.

As shown in FIG. 2, FIG. 4, and FIG. 5, a rocker arm 15 for a low speed and a rocker arm 20 for a high speed constituting a variable valve mechanism V are provided adjacent to each other on the rocker shaft 7. The rocker arm 15 for a low speed corresponds to a first rocker arm in this invention and the rocker arm 20 for a high speed corresponds to a second rocker arm in this invention.

The rocker arm 15 for a low speed of the rocker arms 15 and 20 will be explained below. The rocker arm 15 has a cylindrical boss portion 16*a* and an arm portion 16*b*. The boss portion 16*a* is rotatably provided at a portion of the rocker shaft 7 corresponding to a cylinder center. The arm portion 16*b* extends from the boss portion 16*a* toward the intake valve 2.

Figure 3:
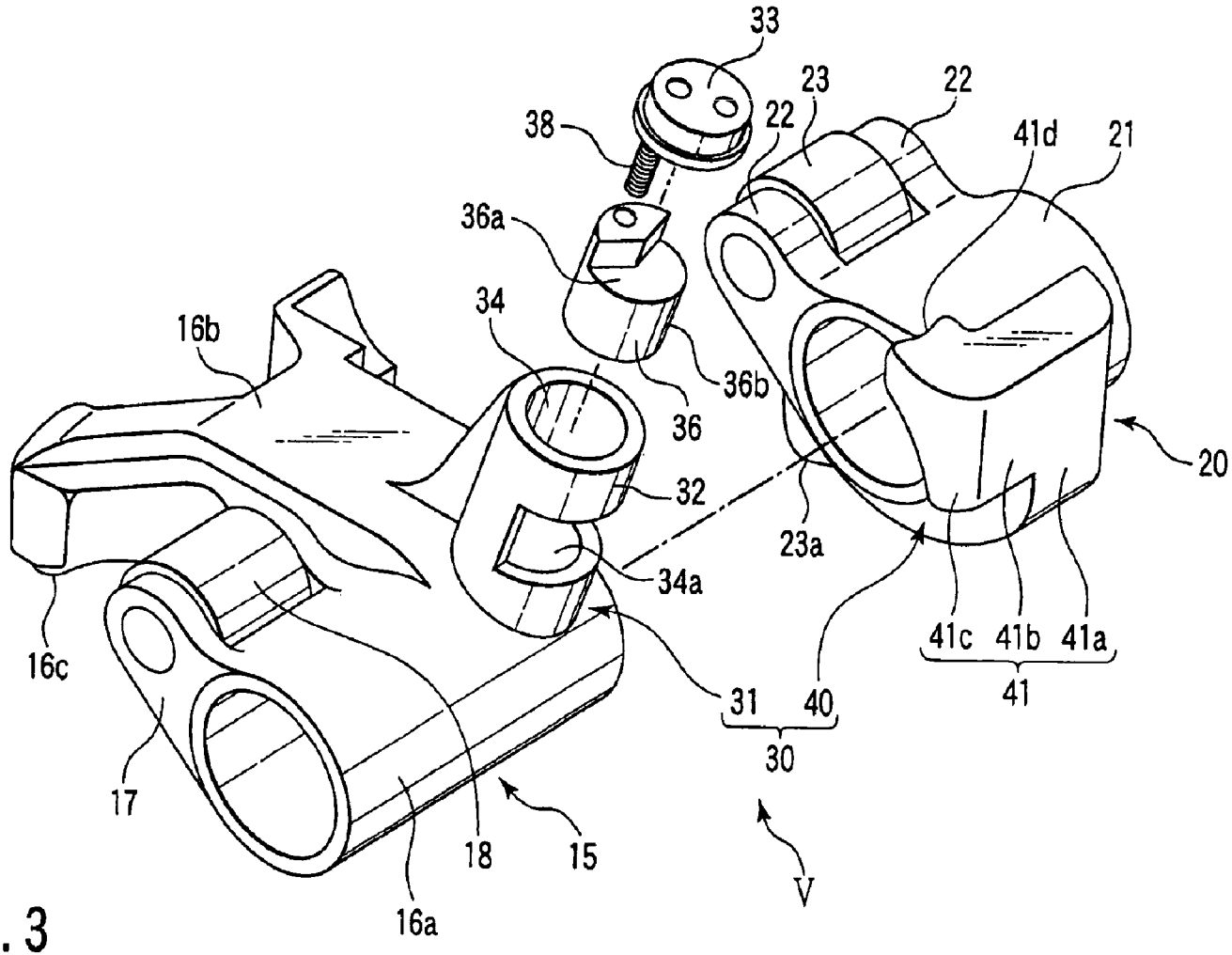
FIG. 3 is an exploded perspective view of the variable valve mechanism shown in FIG. 1.

A distal end of the arm portion 16*b* is branched in an almost Y-shape. Valve tapping portions 16*c* are formed on distal ends of the branched arm portion 16*b*. Each valve tapping portion 16*c* is arranged just above each valve stem 3*a* of each intake valve 2. As shown in FIG. 2, FIG. 3 and the like, a left side boss portion projecting from the arm portion 16*b* is provided with a roller supporting wall 17. The roller supporting wall 17 projects toward just below the cam 9*a* for a low speed.

A roller 18 serving as a cam receiver is rotatably supported between the distal end of the roller supporting wall 17 and a side face of the arm portion 16*b* opposed thereto. As shown in FIG. 1, the roller 18 comes in rolling contact with the cam 9*a* for a low speed on the camshaft 8. The roller 18 is subjected to displacement of the cam 9*a* from a lower side of the camshaft 8. When the cam 9*a* for a low speed rotates, the arm portion 16*b* rotationally displaces around the rocker shaft 7 along the cam profile of the cam 9*a*. Thereby, the displacement of the cam 9*a* leads to the valve stem 3*a* so that the intake valve 2 is pushed down to be opened.

As shown in FIG. 2, the rocker arm 20 for a high speed has a boss portion 21, a pair of roller supporting wall 22, and a roller 23. The boss portion 21 is rotatably fitted on the rocker shaft 7. The boss portion 21 is disposed adjacent to the boss portion 16*a* of the rocker arm 15 for a low speed. The pair of roller supporting walls 22 project from the boss portion 21 just downwardly of the cam 9*b* for a high speed. The roller 23 is rotatably supported between distal ends of the roller supporting walls 22.

The roller supporting wall 22 is pushed up by a pin-like pushing-up member 24 (refer to FIG. 1). The pushing-up member 24 is biased upwardly by a return spring 24*a* received in the cylinder head 1. The roller 23 is put in contact with the cam 9*b* for a high speed by a biasing force or a resilient force of the return spring 24*a*. A strengthened portion 23*a* is formed on a lower portion of the roller supporting wall 22. The strengthened portion 23*a* abuts on a distal end of the pushing-up member 24. When the cam 9*b* for a high speed rotates, the rocker arm 20 rotationally displaces around the rocker shaft 7 along the cam profile of the cam 9*b*.

A switching mechanism 30 is provided between the rocker arms 15 and 20. The switching mechanism 30 has a function for transmitting cam displacement of one of the cam 9*a* for a low speed and the cam 9*b* for a high speed to the intake valve 2. In this valve train, the camshaft 8 is disposed obliquely above the rocker shaft 7. A dead space 6 is present in a region surrounded by an upper side of the rocker shaft 7 and a side of the camshaft 8. The switching mechanism 30 is received in the dead space 6 of such a valve train.

Figure 6:
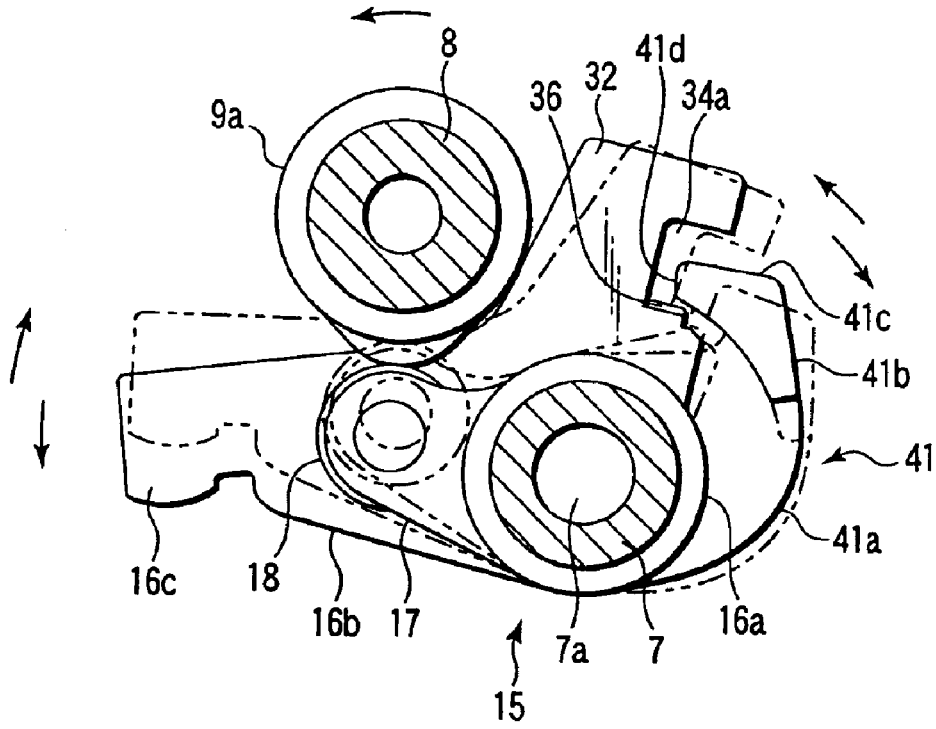
FIG. 6 is a sectional view of the variable valve mechanism as viewed from in a direction of arrow C in FIG. 2 when a cam for a low speed is selected.
Figure 7:
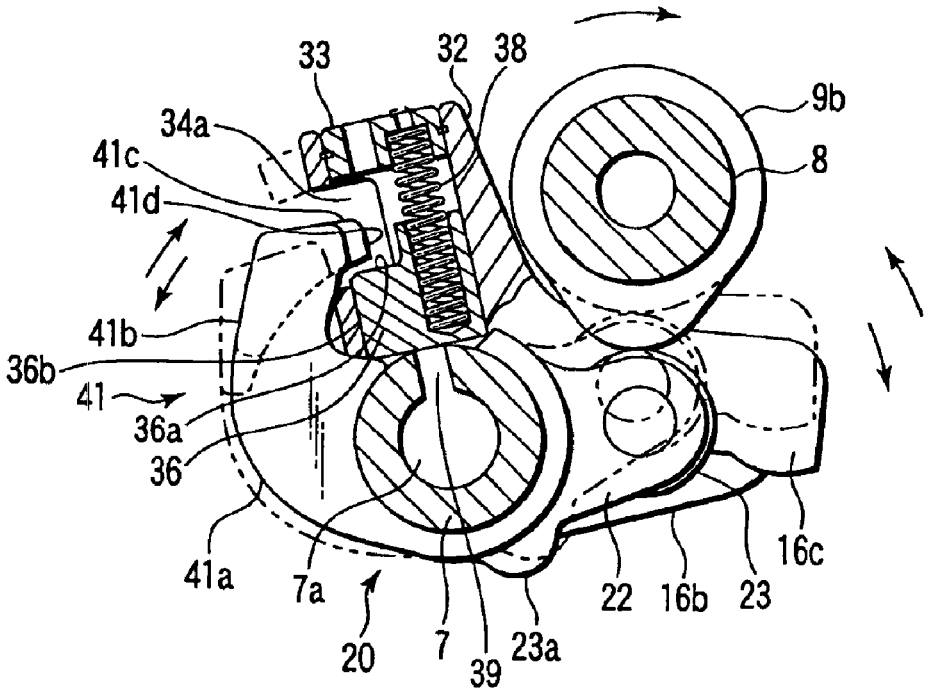
FIG. 7 is a sectional view of the variable valve mechanism as viewed from in a direction of arrow D in FIG. 2 when the cam for a low speed is selected.
Figure 8:
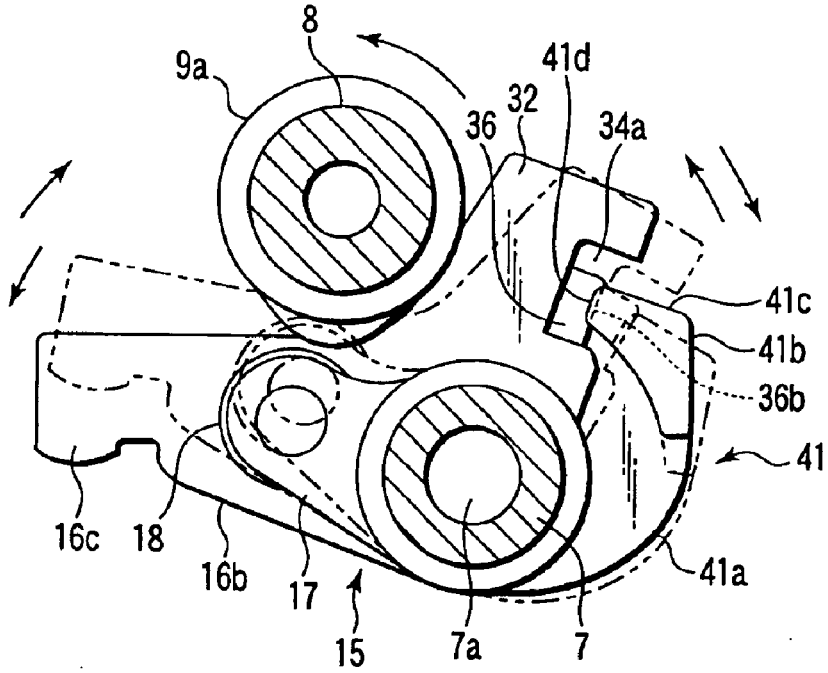
FIG. 8 is a sectional view of the variable valve mechanism as viewed from in a direction of arrow C in FIG. 2 when a cam for a high speed is selected.
Figure 9:
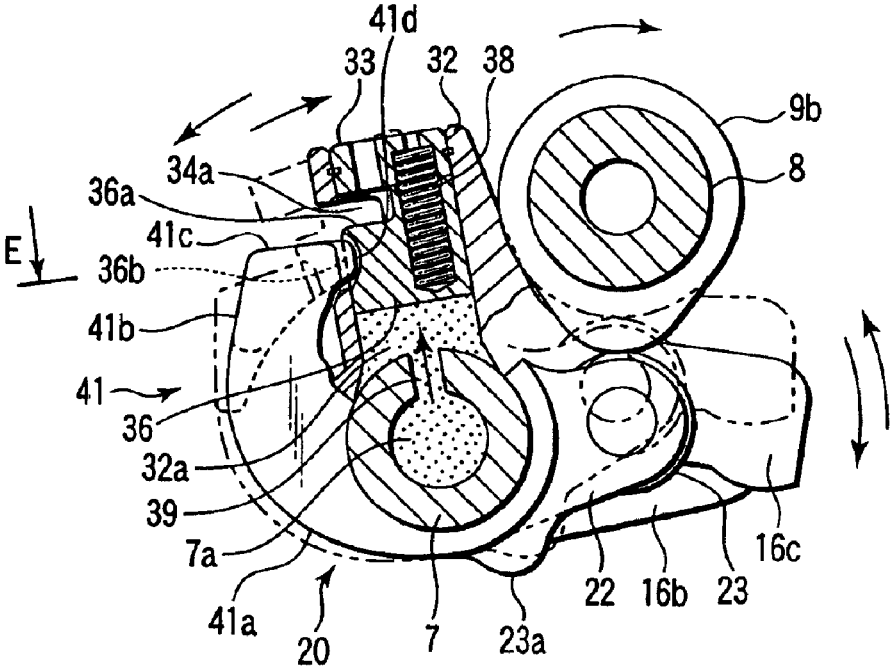
FIG. 9 is a sectional view of the variable valve mechanism as viewed from in a direction of arrow D in FIG. 2 when the cam for a high speed is selected.

The switching mechanism 30 employs a pushing type configuration for reducing stress. FIG. 2 shows an appearance of the whole switching mechanism 30. FIG. 3 is a perspective view showing the switching mechanism 30 in an exploded manner. FIG. 4 is a plan view of the switching mechanism 30. FIG. 5 is a rear view of the switching mechanism 30. FIG. 6 and FIG. 7 are sectional views of the variable valve mechanism when the intake valve 2 is driven by the cam 9*a* for a low speed, respectively. FIG. 8 and FIG. 9 are sectional views of the variable valve mechanism when the intake valve 2 is driven by the cam 9*b* for a high speed, respectively.

The switching mechanism 30 has a first abutting portion 31 and a second abutting portion 40. The first abutting portion 31 rotationally displaces together with the rocker arm 15 for a low speed. The second abutting portion 40 rotationally displaces together with the rocker arm 20 for a high speed. The abutting portions 31 and 40 are arranged in alignment with each other along a rotational direction of the rocker arms 15 and 20. Specifically, the first abutting portion 31 is disposed on a side near to the camshaft 8, and the second abutting portion 40 is disposed on a side far from the camshaft 8 on an opposite side from the first abutting portion 31. The first abutting portion 31 has a vertical piston configuration, for example.

The first abutting portion 31 with the vertical piston configuration will be explained below. The first abutting portion 31 has a cylindrical accommodating cylinder 32. The accommodating cylinder 32 projects upwardly from a portion near to the rocker shaft 7 of the rocker arm 15, for example, an upper portion of the boss portion 16*a*. The accommodating cylinder 32 is inclined in a direction apart from the camshaft 8 in order to avoid interference with the camshaft 8.

As shown in FIG. 1, a hollow portion inside the accommodating cylinder 32 is continuous to an inner face of the boss portion 16*a*. An opening at an upper end of the accommodating cylinder 32 is closed by a lid member 33. An accommodating chamber 34 is formed inside the accommodating cylinder 32 extending from the lid member 33 to an outer peripheral face of the rocker shaft 7. The accommodating chamber 34 is column-shaped, for example, cylindrical.

A window 34*a* is formed on a rear face wall (an opposite side from the camshaft 8) of the accommodating chamber 34. The window 34*a* is formed by cutting a portion of the rear face wall (the opposite side from the camshaft 8) of the accommodating cylinder 32 in, for example, a rectangular shape. A switching element 36 functioning as a piston is slidably accommodated in the accommodating chamber 34 having the window 34*a*.

The switching element 36 is movable only in a vertical direction or in upward and downward directions while keeping its constant attitude without rotating owing to a detent mechanism. As shown in FIG. 1, the detent mechanism is constituted of a groove portion 37*a* and a pin 37*b*.

The groove portion 37*a* is formed on a one portion of an outer peripheral face of the switching element 36 to extend in an axial direction of the switching element 36. The pin 37*b* is inserted into a peripheral wall portion of the accommodating cylinder 32 so as to cross the groove portion 37*a*.

A notched portion 36*a* is formed on one portion, for example, an upper stage portion of a rear face portion (an opposite portion from the camshaft 8), of the switching element 36. The notched portion 36*a* is formed at a position corresponding to the window 34*a*. As shown in FIG. 1, when the switching element 36 is moved down to a lowermost position, the notched portion 36*a* is positioned at the window 34*a*. When the switching element 36 is moved up to an uppermost position, an outer peripheral portion 36*b* of the switching element 36 just below the notched portion 36*a* is eventually positioned at the window 34*a*.

The switching element 36 is always moved, by a coil spring 38, to a position where the notched portion 36*a* faces the window 34*a*. The coil spring 38 is only one example of a resilient member and it is confined between the lid member 33 and the switching element 36 in a compressed state. The switching element 36 can be pushed up to an ascended position against the coil spring 38 by hydraulic pressure introduced into an oil chamber 32*a*. When the switching element 36 is moved up to the ascended position, the outer peripheral portion 36*b* of the notched portion 36*a* faces the window 34*a*.

A hydraulic configuration for driving the switching element 36 is constituted of the hydraulic chamber 32*a*, a passage 7*a* formed in the rocker shaft 7, a through hole 39, and the like. Engine oil is supplied to the passage 7*a*. The through hole 39 is formed on a peripheral wall of the rocker shaft 7. The oil chamber 32*a* in a lower portion of the accommodating chamber 34 and the passage 7*a* are in communication with each other via the through hole 39. An oil control valve 35 which opens and closes the passage 7*a* is provided in the passage 7*a* for engine oil.

The oil control valve 35 is controlled to close in a low rpm region of engine operation by an engine control computer (not shown). When the oil control valve 35 is closed, a hydraulic pressure in the oil chamber 32*a* lowers, so that the notched portion 36*a* is positioned at the window 34*a*. When the engine is operated in a high rpm region higher than the low rpm region, control is performed for opening the oil control valve 35. When the oil control valve 35 is opened, the switching element 36 is pushed up by a pressure of engine oil supplied to the oil chamber 32*a*. Thereby, the outer peripheral portion 36*b* of the switching element 36 is positioned at the window 34*a*. The through hole 39 is formed at a position where oil (or oil pressure) can be supplied to the oil chamber 32*a* regardless of a rotational position of the rocker arm 15.

Thus, the first abutting portion 31 can perform selective switching regarding whether the notched portion 36*a* is positioned at the window 34*a* or the outer peripheral portion 36*b* of the switching element 36 is positioned thereat.

The second abutting portion 40 is provided with an arm portion 41. The arm portion 41 projects from a rear face portion (an opposite side from the camshaft 8) of the rocker arm 20 and a distal end thereof curves around a rear face side of the first abutting portion 31.

As shown in FIG. 1 to FIG. 3, the arm portion 41 has a first extending portion 41*a*, a second extending portion 41*b*, and a third extending portion 41*c*. The first extending portion 41*a* projects from a rear face portion (an opposite portion from the camshaft 8) of the boss portion 21 upwardly. The second extending portion 41*b* extends from an end of the first extending portion 41*a* laterally to curve to a point facing the window 34*a* of the accommodating cylinder 32. The third extending portion 41*c* projects forward (in a direction of the camshaft 8) from an end of the extending portion 41*b* toward a point advancing in the window 34*a*.

A distal end 41*d* of the arm portion 41 means, in other words, a distal end of the second abutting portion 40. The distal end 41*d* advances into and retreated from the window 34*a* according to rotational displacement of the rocker arm 20. As shown in FIG. 6 and FIG. 7, when the notched portion 36*a* is positioned at the window 34*a*, the distal end 41*d* moves into the notched portion 36*a* without coming in contact with the outer peripheral portion 36*b*. As shown in FIG. 8 and FIG. 9, when the outer peripheral portion 36*b* of the switching element 36 is positioned at the window 34*a*, the distal end 41*d* rotates around the rocker shaft 7 along with the outer peripheral portion 36*b*, while coming in contact with the outer peripheral portion 36*b*.

When the distal end 41*d* of the arm portion 41 does not abut on the switching element 36, cam displacement is transmitted from the rocker arm 15 for a low speed to the intake valve 2. On the contrary, when the distal end 41*d* of the arm portion 41 abuts on the switching element 36 in a rotational direction of the rocker arms 15 and 20, cam displacement from the rocker arm 20 for a high speed is transmitted to the intake valve 2 via the rocker arm 15 for a low speed.

In this embodiment, the first abutting portion 31 with a large height size having the piston configuration of the constituent elements or parts for the switching mechanism 30 is disposed on the side of the camshaft 8 positioned relatively high. The second abutting portion 40 with a relatively low height having the arm configuration is disposed at a low position on an opposite side from the camshaft 8. Thus, the constituent elements for the switching mechanism 30 are arranged so as not to be protruded from the dead space δ (shown in FIG. 2) between the rocker shaft 7 and the camshaft 8 to the utmost.

Next, in the switching mechanism 30 with the above configuration, an operation for switching the cam 9*a* for a low speed and the cam 9*b* for a high speed will be explained.

For example, it is assumed that the engine is operated at a low rpm. At this time, since the oil control valve 35 is closed, oil pressure is not supplied to the oil chamber 32*a* in the rocker arm 15. Incidentally, a small amount of oil is supplied for lubrication between the rocker shaft 7 and the rocker arm 15. A small hole is formed in the oil control valve 35 in order to secure the lubrication oil. However, since only a small amount of lubrication oil flows, hydraulic pressure such as allowing pushing-up of the switching element 36 does not occur in the oil chamber 32*a*. As shown in FIG. 1, FIG. 6, and FIG. 7, therefore, the switching element 36 is biased downwardly by the coil spring 38, so that the notched portion 36*a* is positioned at the window 34*a*.

At this time, the distal end 41*d* of the arm portion 41 of the rocker arm 20 for a high speed swung by the cam 9*b* for a high speed merely reciprocates in front and rear directions in the space in the notched portion 36*a* of the switching element 36, as shown in FIG. 6 and FIG. 7. Therefore, cam displacement from the rocker arm 20 for a high speed is not transmitted to the rocker arm 15 for a low speed.

As shown in FIG. 6 and FIG. 7, therefore, only movement of the rocker arm 15 for a low speed which is rotationally displaced by the cam 9*a* for a low speed is transmitted to the valve stem 3 to push down the intake valve 2. Accordingly, the intake valve 2 is driven at a valve opening/closing timing and with a valve lift amount suitable for a low speed operation performed by the cam 9*a* for a low speed.

On the other hand, when the engine is operated in an operation state performing cam switching, for example, in a high speed region where the rpm of the engine exceeds a predetermined threshold, the oil control valve 35 is opened. Thereby, the engine oil is pressure-fed to the oil chamber 32*a* through the passage 7*a* in the rocker shaft 7 to push up the switching element 36. As a result, as shown in FIG. 8 and FIG. 9, the outer peripheral portion 36*b* is positioned at the window 34*a* just below the notched portion 36*a*.

Figure 10:
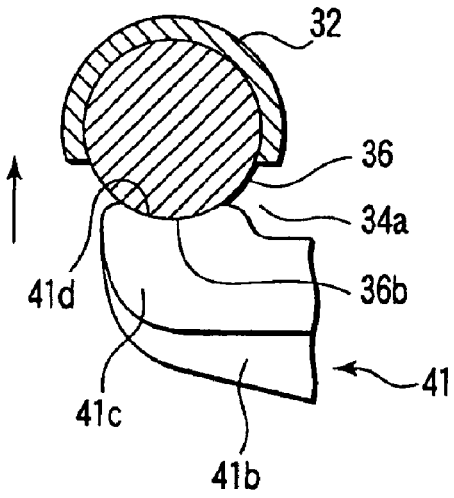
FIG. 10 is a sectional view showing a state that a distal end of a second abutting portion is in contact with a switching element along line E in FIG. 9.

The distal end 41*d* of the arm portion 41 abuts on the outer peripheral portion 36*b* of the switching element 36 from the neighborhood where a contacting portion between the cam 9*b* for a high speed and the roller 23 exceeds the base circle of the cam profile of the cam 9*b* (refer to FIG. 10). Thereby, as shown in FIG. 8 and FIG. 9, since the distal end 41*d* of the arm portion 41 of the rocker arm 20 for a high speed pushes the outer peripheral portion 36*b* of the switching element 36, the rocker arm 15 for a low speed is pushed.

Here, the rocker arm 15 for a low speed is driven in the same direction as a rotational direction of the rocker arm 15. Therefore, the switching element 36 is pushed in the rotational direction of the rocker arm 15 for a low speed according to rotation of the rocker arm 20 for a high speed.

According to this behavior, cam displacement from the rocker arm 20 for a high speed is transmitted to the rocker arm 15 for a low speed so that the rocker arm 15 for a low speed is rotated. In this manner, cam displacement of the rocker arm 20 for a high speed is transmitted to the valve stem 3*a* via the rocker arm 15 for a low speed to push down the intake valve 2. That is, the cam driving the intake valve 2 is switched from the cam 9*a* for a low speed to the cam 9*b* for a high speed.

The valve lift amount of the cam 9*b* for a high speed is larger than that of the cam 9*a* for a low speed. Therefore, as shown in FIG. 8, the cam 9*a* for a low speed is separated from the roller 18. That is, the roller 18 separates from a portion of the cam 9*a* for a low speed except for the base circle thereof. Accordingly, the opening/closing timing and the valve lift amount of the cam 9*a* for a low speed are not transmitted to the valve stem 3*a*. Instead, only the opening/closing timing and the valve lift amount suitable for a high speed operation of the cam 9*b* for a high speed are transmitted to the valve stem 3*a*.

In this embodiment, cam displacement from the rocker arm 20 for a high speed is transmitted to the rocker arm 15 for a low speed by causing the distal end 41*d* of the arm portion 41 of the rocker arm 20 for a high speed to abut on the switching element 36 from a rotational direction of the rocker arm 15 for a low speed. By employing such a constitution, only a bending stress mainly occurs in the first abutting portion 31 and the second abutting portion 40 which transmit a driving force of the intake valve 2 but a severe stress such as a shearing stress does not occur therein.

In addition, the first abutting portion 31 is constituted to have a piston configuration rotated together with the rocker arm 15 for a low speed and the second abutting portion 40 is constituted to have an arm configuration rotated together with the rocker arm 20 for a high speed. The first abutting portion 31 and the second abutting portion 40 are substantially received in the dead space δ defined by the upper portion of the rocker shaft 7 and the side portion of the camshaft 8. Therefore, the first abutting portion 31 and the second abutting portion 40 are prevented from projecting to the surroundings of the rocker shaft 7 or the camshaft 8 largely.

For this reason, both of the compactness of the cylinder head 1 and the reduction in stress acting on the switching mechanism 30 can be achieved and switching of the cams 9*a* and 9*b* can be performed. In this embodiment, especially, the first abutting portion 31 with the relatively large height size formed in the piston configuration is disposed on a side near to the camshaft 8 and the second abutting portion 40 formed in the arm configuration whose height can be set to be smaller than that of the piston configuration is disposed on a side far from the camshaft 8. Therefore, the constituent elements for the switching mechanism 30 is prevented from projecting laterally of the rocker shaft 7 largely, so that the switching mechanism 30 can be provided by utilizing the spatially restricted region above the cylinder head sufficiently.

Moreover, the switching mechanism 30 can be constituted by a simple combination of parts such as the switching element 36 formed with the notched portion 36*a*, the accommodating chamber 34 accommodating the switching element 36, and the distal end 41*d* advancing to and retracting from the window 34*a*. Consequently, the switching mechanism 30 can be implemented at low cost. Furthermore, the switching element 36 can be supported by the accommodating cylinder 32 constituting the wall of the accommodating chamber 34. Since a load applied from the distal end 41*d* is received by the accommodating cylinder 32, stress burden on a portion for transmission of a driving force, namely, the switching element 36 is reduced so that reliability of the cam switching operation is further improved.

In this embodiment, the coil spring 38 with a simple configuration and hydraulic pressure supplied to the oil chamber 32*a* are utilized for a switching operation in the switching mechanism 30. Since engine oil can be utilized for hydraulic pressure generation, switching of the cams 9*a* and 9*b* can be performed with a simple configuration.

The present invention is not limited to the embodiment described above and it may be implemented with various modifications made without departing from the gist of the present invention. For example, the above embodiment has been explained about the intake valve, but the present invention can be applied to not only driving the intake valve but also driving an exhaust valve. In the embodiment, switching between the positions of the switching element is performed utilizing hydraulic pressure, but this invention is not limited to such utilization of the hydraulic pressure. Switching of positions of the switching element may be performed by another configuration or mechanism. The case that switching of the cams for a low speed and for a high speed is performed according to the rpm of the engine has been explained, but this invention is not limited to this case. For example, cam switching may be made according to a load on the engine or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve mechanism for an engine, where the engine has:

a rocker shaft which is arranged to a cylinder head;

a camshaft which is arranged on the cylinder head in parallel with the rocker shaft and above the rocker shaft and has a first cam and a second cam which are different in cam profile from each other;

a first rocker arm which is rotatably supported by the rocker shaft and is driven by the first cam, and which transmits a displacement of the first cam to a valve; and a second rocker arm which is rotatably supported by the rocker shaft in parallel to the first rocker arm and is driven by the second cam, wherein the variable valve mechanism has a switching mechanism which allows selective transmission of a displacement of the second rocker arm to the first rocker arm, the switching mechanism which is provided sideward of the camshaft, and the switching mechanism comprises:

a first abutting portion which is provided on the first rocker arm;

a second abutting portion which is provided on the second rocker arm and opposed to the first abutting portion with respect to rotational direction around the rocker shaft; and a switching element which is provided on one abutting portion of the first abutting portion and the second abutting portion, the switching element being displaceable to a first position where the switching element abuts on the other abutting portion of the first abutting portion and the second abutting portion to transmit displacement of the second rocker arm to the first rocker arm and a second position where the switching element does not abut on the other abutting portion.

2. A variable valve mechanism according to claim 1, wherein the first abutting portion is positioned at a side near to the camshaft to project from an upper portion of the first rocker arm, and the second abutting portion is positioned at a side far from the camshaft to be arranged so that a distal end thereof curves around a rear face side of the first abutting portion.

3. A variable valve mechanism according to claim 2, wherein the first abutting portion has a cylindrical accommodating chamber which has a shape of projecting from an upper portion of the first rocker arm and has a window on a rear face side thereof, and the switching element which is movably accommodated in the accommodating chamber and is formed with a notched portion on an outer peripheral portion thereof, the first abutting portion being configured such that the notched portion and the outer peripheral portion can be selectively positioned at the window, and the second abutting portion has a distal end which advances to and retracts from the window according to rotational displacement of the second rocker arm, the second abutting portion being configured such that the distal end enters in the notched portion, when the notched portion is positioned at the window, and the distal end abuts on the outer peripheral portion, when the outer peripheral portion is positioned at the window.

4. A variable valve mechanism according to claim 3, wherein the switching element is always biased to a position where the notched portion faces the window by a resilient member, and is moved at a position where the outer peripheral portion faces the window, when hydraulic pressure is applied to the switching element.

5. A variable valve mechanism according to claim 3, further comprising an oil chamber to move the switching element by hydraulic pressure, wherein an oil passage communicating with the oil chamber is formed in the rocker shaft.

6. A variable valve mechanism according to claim 3, further comprising a detent mechanism which prevents rotation of the switching element around an axis of the switching element.

7. A method of changing a valve of an engine, wherein the engine comprises:

a rocker shaft which is arranged on a cylinder head;

a camshaft which is arranged on the cylinder head in parallel with the rocker shaft and above the rocker shaft and has a first cam and a second cam which are different in cam profile from each other;

a first rocker arm which is rotatably supported by the rocker shaft and is driven by the first cam, and which transmits a displacement of the first cam to a valve;

a second rocker arm which is rotatably supported by the rocker shaft in parallel to the first rocker arm and is driven by the second cam;

a first abutting portion which is provided on the first rocker arm;

a second abutting portion which is provided on the second rocker arm and is opposed to the first abutting portion with respect to rotational direction around the rocker shaft; and a switching element which is provided on one abutting portion of the first abutting portion and the second abutting portion, the switching element being displaceable to a first position where the switching element can abut on the other abutting portion of the first abutting portion and the second abutting portion and a second position where the switching element does not abut on the other abutting portion, the method comprising:

moving the switching element to the first position at a time of transmission of displacement of the second locker arm to the first locker arm, and moving the switching element to the second position at a time of non-transmission of displacement of the second locker arm to the first locker arm.

* * * * *